US007942240B2

(12) United States Patent
Olsen

(10) Patent No.: US 7,942,240 B2
(45) Date of Patent: May 17, 2011

(54) SILENCER FOR INTERNAL COMBUSTION ENGINE

(75) Inventor: Douglas M. Olsen, Plain City, OH (US)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 12/480,343

(22) Filed: Jun. 8, 2009

(65) Prior Publication Data

US 2010/0307865 A1 Dec. 9, 2010

(51) Int. Cl.
*F01N 1/02* (2006.01)
*F01N 1/08* (2006.01)

(52) U.S. Cl. ..... 181/269; 181/272; 181/281; 181/238; 181/239

(58) Field of Classification Search ..... 181/249, 181/255, 264, 269, 272, 281, 282, 238, 239, 181/275
See application file for complete search history.

(56) References Cited

U.S. PATENT DOCUMENTS

| | | | | | |
|---|---|---|---|---|---|
| 2,187,431 | A | * | 1/1940 | Powell | 29/890.08 |
| 2,835,336 | A | * | 5/1958 | Deremer | 181/282 |
| 2,928,492 | A | * | 3/1960 | Nelson | 181/275 |
| 3,072,214 | A | * | 1/1963 | Deremer | 181/250 |
| RE25,384 | E | * | 5/1963 | Bryant | 181/275 |
| 4,132,286 | A | | 1/1979 | Hasui et al. | |
| 4,192,401 | A | * | 3/1980 | Deaver et al. | 181/266 |
| 4,941,545 | A | * | 7/1990 | Wilcox et al. | 181/282 |
| 5,012,891 | A | | 5/1991 | Macaluso | |
| 5,147,987 | A | | 9/1992 | Richardson et al. | |
| 5,229,557 | A | * | 7/1993 | Allman et al. | 181/282 |
| 5,597,986 | A | | 1/1997 | Harwood et al. | |
| 6,135,237 | A | | 10/2000 | Allman | |
| 6,164,412 | A | * | 12/2000 | Allman | 181/272 |
| 6,260,659 | B1 | | 7/2001 | Takahashi et al. | |
| 6,341,664 | B1 | | 1/2002 | Gerber | |
| 6,405,827 | B1 | | 6/2002 | Church | |
| 6,571,911 | B2 | | 6/2003 | Watanabe et al. | |
| 6,659,222 | B1 | | 12/2003 | Allman | |
| 6,942,061 | B2 | * | 9/2005 | Butterfield et al. | 181/275 |
| 2009/0014236 | A1 | * | 1/2009 | Van De Flier et al. | 181/256 |

* cited by examiner

*Primary Examiner* — Elvin Enad
*Assistant Examiner* — Jeremy Luks
(74) *Attorney, Agent, or Firm* — Rankin Hill & Clark LLP

(57) ABSTRACT

A silencer for an internal combustion engine includes a silencer housing formed by a pair of clamped housing members each having a substantially identical configuration relative to one another. The silencer housing has an intake port formed at a first end and an exhaust port formed at a second, opposite end. At least one separator is received in the silencer housing between and spaced apart from the first end and the second end. The at least one separator extends transversely across the silencer housing relative to a longitudinal length of the silencer housing.

17 Claims, 9 Drawing Sheets

SILENCER FOR INTERNAL COMBUSTION ENGINE

BACKGROUND

Exemplary embodiments herein generally relate to a silencer or muffler adapted to be connected to an exhaust system of an engine, and more particularly relate to an improved muffler or silencer and method of constructing same.

A conventional silencer, connected to an exhaust system of an automotive engine, includes an inlet pipe, an outlet pipe, and an expansion chamber. The inlet pipe is continuously connected to an exhaust pipe from the engine, whereas the outlet pipe is open to atmosphere. The expansion chamber provides communication between the inlet pipe and the outlet pipe.

With reference to FIGS. 11*a* and 11B, a known silencer 10 includes an outer shell 12 formed of a wrapped sheet of material, such as steel. In particular, a sheet of material, which can be double-layered sheet, is wrapped into an oval shape and spot-welded together. Silencer internals, including an intake pipe section 14, an exhaust pipe section 16, and a pair of supports 18, 20, are press-fit into the wrapped shell 12 and then end plates 22, 24 are secured to opposite ends of the shell 12. The end plates 22, 24 can be curl-seamed, including double-end curl-seamed, to ends of the shell 12 to prevent exhaust leakage at the seam between the end plates 22, 24 and the shell 12.

As shown, the end plates 22, 24 respectively define an intake port 26, which is in registry with an end opening 14*a* of the intake pipe section 14 and an exhaust port 28, which is in registry with an end opening 16*a* of the exhaust pipe section 16. One of the supports 18, 20 (e.g., support 20) can be generally a solid wall to divide an inner chamber of the shell 12 into separate chambers. More specifically, an opposite end 14*b* of the intake pipe 14 can be received through the solid separator 20 so as to direct intake exhaust into a resonator chamber 30 defined between the solid separator 20 and the adjacent end plate 24. Perforations 32 can be provided circumferentially on the intake pipe section 14 on an opposite side of the solid support 20. The other support 18 can have an aperture 34 defined therethrough for fluidly connecting the circumferential perforations 32 with an inlet end 16*b* of the exhaust pipe section 16.

BRIEF DESCRIPTION

In accordance with one aspect, a silencer for an internal combustion engine is provided. More particularly, in accordance with this aspect, the silencer includes a silencer housing formed by a pair of clamped housing members each having a substantially identical configuration relative to one another. The silencer housing has an intake port formed at a first end and an exhaust port formed at a second, opposite end. At least one separator is received in the silencer housing between and spaced apart from the first end and the second end. The at least one separator extends transversely across the silencer housing relative to a longitudinal length of the silencer housing.

According to another aspect, a method of constructing a silencer for an internal combustion engine is provided. More particularly, in accordance with this aspect, a pair of clamshell housing members, each having a substantially identical configuration relative to one another, and at least one separator are formed. The at least one separator is positioned between the pair of clamshell housing members for dividing a cavity formed between the housing members when the housing members are brought together into separate expansion chambers. The at least one separator is oriented transversely relative to a longitudinal length of the pair of housing members. The pair of housing members are secured to one another to form the cavity therebetween and lock the at least one separator longitudinally between the pair of housing members.

According to a further aspect, the vehicle muffler is provided. More particularly, in accordance with this aspect, the vehicle muffler includes a first clamshell member secured to a second clamshell member to form a housing defining a cavity. The first and second clamshell members have a substantially identical configuration. At least one separator is received between the first and second clamshell members to divide the cavity. At least one of the at least one separator and the first and second clamshell members is configured such that the at least one separator is longitudinally locked by the first and second clamshell members.

DETAILED DESCRIPTION

Figure 1:
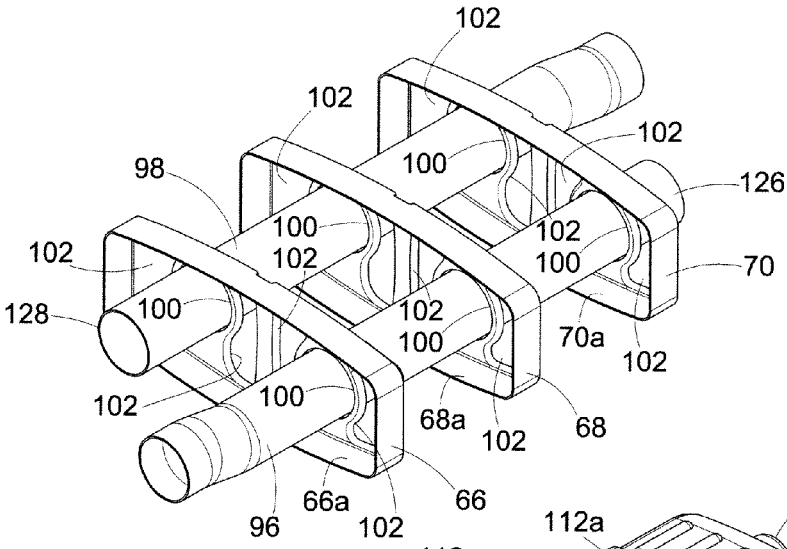
FIG. 1 is a perspective view of a silencer inner assembly including a plurality of separators through which an intake pipe section and an exhaust pipe section are received.

Referring now to the drawings, wherein the showings are for purposes of illustrating one or more exemplary embodiments, an improved silencer or muffler 50 is illustrated for an internal combustion engine (not shown). With reference to FIGS. 1-4, the silencer 50 includes a silencer housing 52 formed by a pair of clamped housing members 54, 56 each having a substantially identical configuration relative to one another. The silencer housing 52 has an intake port 58 formed at a first end 60 of the housing 52 and an exhaust port 62 formed at a second, opposite end 64 of the housing 52. The silencer 50 further includes at least one separator received in the silencer housing 52 between and spaced apart from the first end 60 and the second end 64. More particularly, in the illustrated embodiment, three separators 66, 68, 70 are received in the silencer housing 52 between and spaced apart from the first and second ends 60, 64. As shown, the separators 66, 68, 70 are also spaced apart from one another and each extends transversely across the silencer housing 52 relative to a longitudinal length of the silencer housing.

In the illustrated embodiment, each of the separators 66, 68, 70 has a circumferential edge formed by respective flange portions 66*a*, 68*a*, 70*a* that mates with an interior surface wall 72 of the silencer housing 52. The separators (e.g., first separator 66 and second separator 68) can have a substantially identical configuration relative to one another and can be spaced apart from one another along the longitudinal length of the silencer housing 52. In the illustrated embodiment, all three separators, the first separator 66, the second separator 68, and the third separator 70, have a substantially identical configuration and are spaced apart from one another along the longitudinal length of the silencer housing 52. The illustrated separators 66, 68, 70 can additionally have configurations that allow each to be independently formed of stamped sheet metal. More particularly, the configuration of each of the separators 66, 68, 70 is such that it can be advantageously formed from a single sheet of stamped sheet material. This reduces manufacturing costs as only a single tool configuration is required for producing the separators 66, 68, 70 of the illustrated embodiment of FIGS. 1-4.

Figure 4:
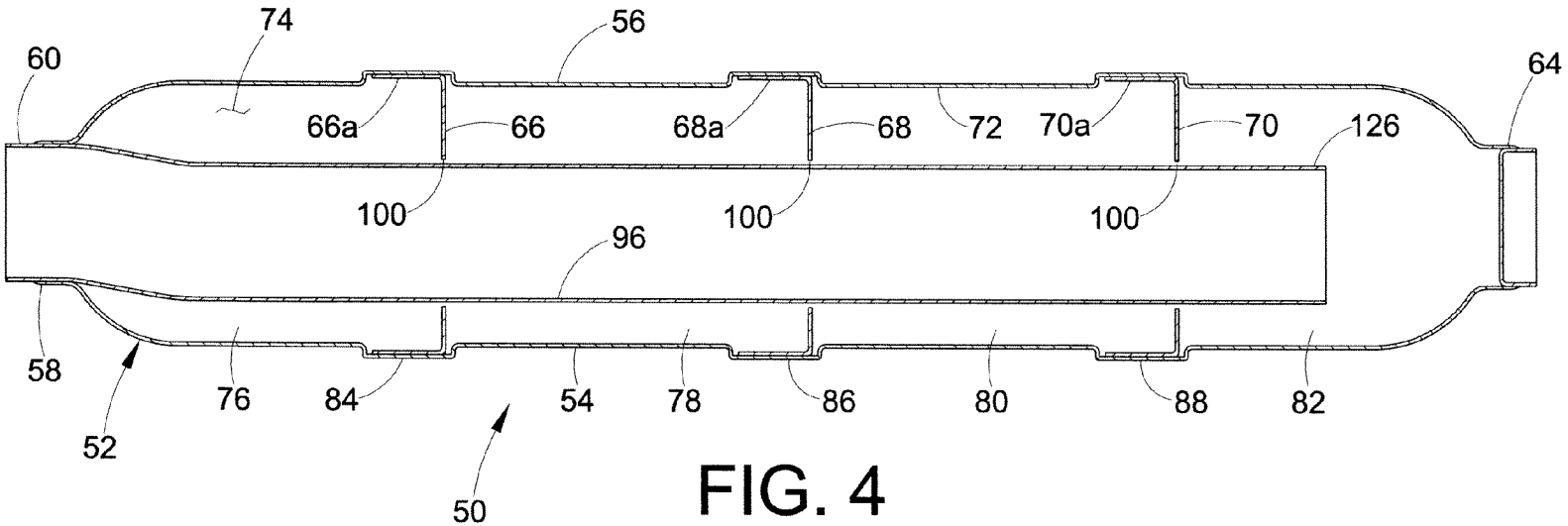
FIG. 4 is a cross sectional view of the silencer of FIG. 2.

When installed in the silencer housing 52, the separators 66, 68, 70 divide an interior 74 of the silencer housing 52. In particular, the separators 66, 68, 70 can divide the interior 74 into separate expansion chambers, including expansion chamber 76, expansion chamber 78, expansion chamber 80, and expansion chamber 82. Additionally, or in the alternative, the separators 66, 68, 70 can provide a supporting function wherein the separators 66, 68, 70 support the housing 52 and/or provide rigidity to the housing 52. The interior wall surface 72 of the silencer housing 52 can include or define at least one circumferential recess in which a corresponding separator is received so as to be longitudinally locked when the lower and upper housing members 54, 56 are secured to one another. In the illustrated embodiment, the interior wall surface 72 defines recesses 84, 86, 88, each corresponding to a respective one of the separators 66, 68, 70. The recesses 84-88 longitudinally lock their respective separators 66-70 when the housing members 54, 56 are secured to one another (as best shown in FIG. 4).

The silencer 50 of the illustrated embodiment further includes an intake pipe section 96 that extends from the intake port 58 through the separators 66, 68, 70. The silencer 50 also includes an exhaust pipe section 98 extending from the exhaust port 62 through the separators 70, 68, 66. The pipe sections 96, 98 can have substantially identical configurations relative to one another to further ease manufacturing costs and complexity. Accordingly, only a single part configured as either of the pipe sections 96, 98 need be manufactured and two of such parts can be used for each silencer 50 produced. In particular, as best shown in FIG. 1, each of the intake pipe section 96 and the exhaust pipe section 98 is fitted through respective apertures 100 in each of the separators 66, 68, 70. The pipe sections 96, 98 can be secured to the separators 66, 68, 70 via press-fit or welding, or some other connection type. Each of the separators 66, 68, 70 can additionally include one or more further apertures 102 for allowing communication between the chambers 76, 78, 80, 82 within the silencer housing 52. If desired, the separators 66, 68, 70 can provide a minimal dividing function, such as when the apertures 100 are sufficiently large and/or numerous, for providing a larger, essentially continuous expansion chamber spanning across the separators 66, 68, 70. In such arrangement, the one or more separators 66, 68, 70 provide more of a supporting function (including supporting and providing rigidity to the housing 52).

The inner assembly, which can comprise the separators 66, 68, 70 and the pipe sections 96, 98, is received between the clamped housing members 54, 56. Advantageously, as already indicated herein, the clamped housing members 54, 56 can have a substantially identical configuration relative to one another. This enables the use of a common stamping for both members 54, 56. Moreover, the common stamping is such that each of the pair of housing members 54, 56 can be independently formed as a single stamped metal piece. With the inner assembly (i.e., the separators 66, 68, 70 and pipe sections 96, 98) held together, the stamped lower and upper housing members 54, 56 can be clamped over the inner assembly and attached to it either via welding or press-fitting. For example, the separators 66, 68, 70 can be welded within the respective recesses 84, 86, 88 or simply press fit in the respective recesses.

Figure 5B:
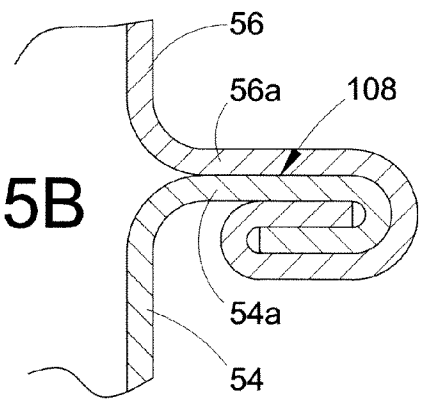
FIG. 5B is a schematic view of a hemmed seam formed between the pair of clamped housing members.
Figure 5A:
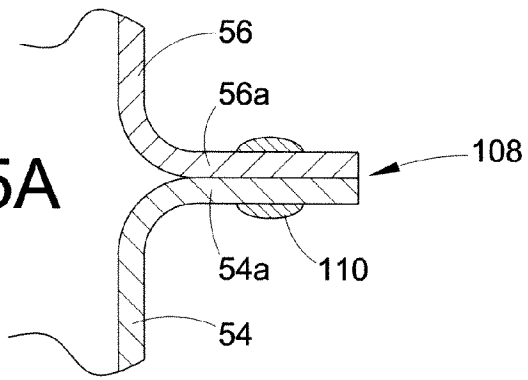
FIG. 5A is a schematic view of a welded seam formed between the pair of clamped housing members.

Once fitted together to form a stamped outer shell 52, the lower and upper housing members 54, 56 can be secured together, such as via welding or curl-seaming, to prevent any exhaust gas leaking. For example, the upper and lower housing member 54, 56 can be secured to one another along a seam 108 (FIGS. 5A and 5B) formed by mating flange portions 54*a* of the lower housing member 54 and 56*a* of the upper housing member 56. In particular, as shown in FIG. 5A, the housing members 54, 56 can be secured to one another along the seam 108 via welding, such as laser, resistance, MIG welding, etc. (as indicated at 110). Alternatively, as shown in FIG. 5B, the upper and lower housing members 54, 56 can be secured to one another along the seam 108 via hemming, and in the illustrated embodiment of FIG. 5B via double hemming (i.e., a curl seam).

Figure 2:
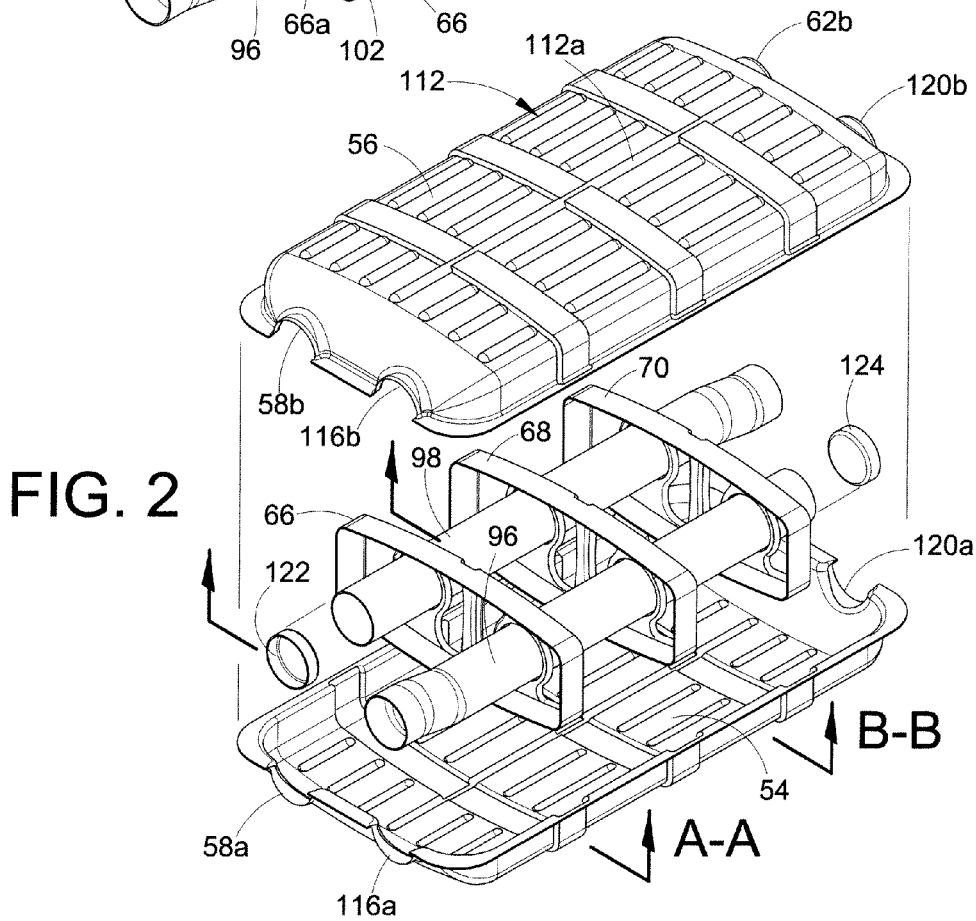
FIG. 2 is an exploded perspective view of an improved silencer including a pair of clamped housing members between which is received the inner assembly of FIG. 1.
Figure 6A:
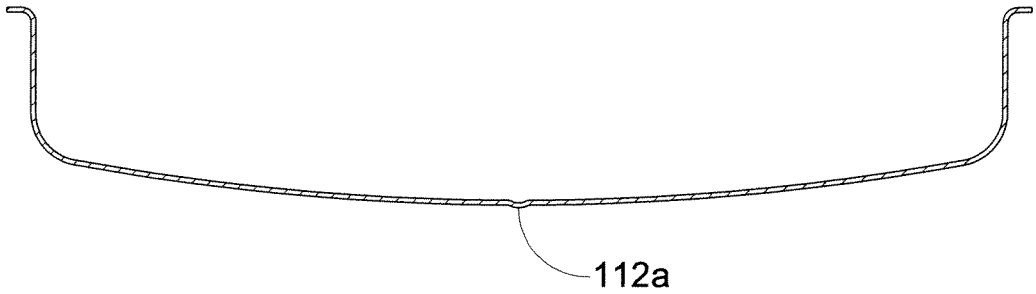
FIG. 6A is a cross-sectional view of the silencer taken through the line A-A of FIG. 2.
Figure 6B:
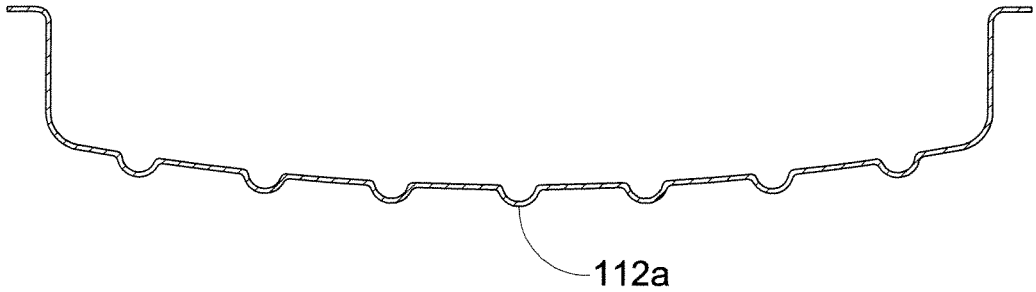
FIG. 6B is a cross-sectional view of the silencer taken through the line B-B of FIG. 2.

As shown best in FIG. 2, the lower and upper housing members 54, 56, and thus the silencer housing 52, can include longitudinally extending ribs 112 to attenuate resonance within the silencer 50 during operation thereof. One or more of the ribs 112 can extend along an entire longitudinal extent of the housing members 54, 56, but can be broken up by the portions of the housing members 54, 56 defining the recesses 84, 86, 88. In addition, or in the alternative, one or more of the ribs can extend along the members 54, 56 without being broken up. In the illustrated embodiment, with additional reference to FIGS. 6A and 6B, center rib 112*a* extends uninterrupted along the housing members 54, 56 and the remaining ribs flanking the center rib 112*a* are interrupted by the recesses 84, 86, 88. Of course, other configurations are contemplated (e.g., other numbers of ribs could be used, any number of ribs could extend uninterrupted or interrupted or no ribs could be uninterrupted or interrupted, the ribs could be removed entirely, etc.).

The silencer housing 52 of the illustrated embodiment defines a pair of ports at each of its first end 58 and its second end 64. With reference to FIG. 2, the ports at the first end 60 are formed by port portions 58*a*, 116*a* in the lower housing member 54 and port portions 58*b*, 116*b* in the upper housing member 56. Similarly, the parts of the second end 64 are formed by port portions in the lower housing member 54 (only port portion 120*a* viewable in FIG. 2) and port portions 62*b*, 120*b* in the upper housing member 56. The port formed by port portions 58*a*, 58*b* at the first end 60 is the intake port 58 (FIGS. 3 and 4) and the other port 114 at the first end 60 is closed with an end cap 122. Likewise, the port formed of port portion 62*b* and the matching port portion in the lower housing member at the second end 64 is the exhaust port 62 and the other port 120 at the second end 64 is closed with another end cap 124. The end caps 122, 124 can be secured within their respective ports to the silencer housing 52 via welding or press-fitting (or some other connecting type).

The illustrated silencer 50 of FIGS. 1-4 uses its entire interior volume comprised of expansion chambers 76, 78, 80, 82 for expansion only. More particularly, exhaust from intake pipe section 96 enters chamber 82 via pipe open end 126 of the intake pipe section 96 but freely moves through chambers 80, 78, 76 and enters exhaust pipe section 98 through pipe open end 128. Thus, the separators 66, 68, 70, with their large apertures 102, pose little barrier to free movement of exhaust from the pipe end aperture 126 of the intake pipe section 96 through to the pipe end aperture 128 of the exhaust pipe section 98. Instead, the separators 66, 68, 70 of the illustrated embodiment primarily support and provide rigidity to the housing 52.

Advantageously, the silencer 50 can be formed at reduced weight and at a lower cost than compared to conventional silencers (e.g., silencer 10). The silencer 50 can additionally be formed to have increased volume, in part due to the support provided by the separators 66, 68 70 along the longitudinal length of the silencer 50, which can lead to improved aerodynamics and/or styling on vehicles employing the silencer 50.

Figure 7:
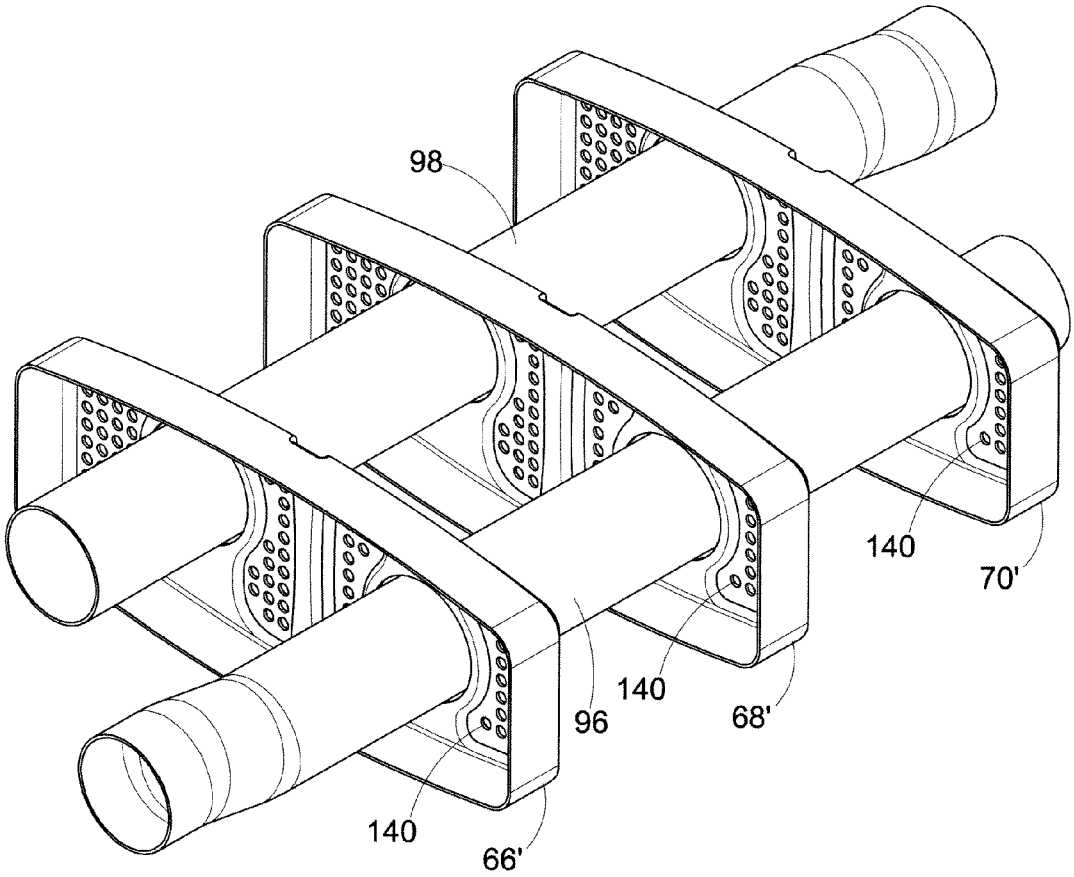
FIG. 7 is a perspective view of an alternate inner assembly similar to FIG. 1 but with separators having perforations defined therethrough.

With reference to FIG. 7, an alternate inner assembly is illustrated wherein separators 66', 68', 70' are substituted for the separators 66, 68, 70 of FIG. 1. Instead of the large apertures 102, the separators 66', 68', 70' include a plurality of perforated holes or apertures 140 defined through their respective separators. In this arrangement, the separators 66', 68', 70' support and add rigidity to the housing 52, and also restrict movement at exhaust through the housing 52. Although not shown, it is to be appreciated that any one or more of separators 66, 68, 70 of FIG. 1 could be substituted for one or more of the separators 66', 68', 70' resulting in a silencer with some separators having large apertures and some having perforation holes. It is also to be appreciated that other separator configurations could be used.

Figure 3A:
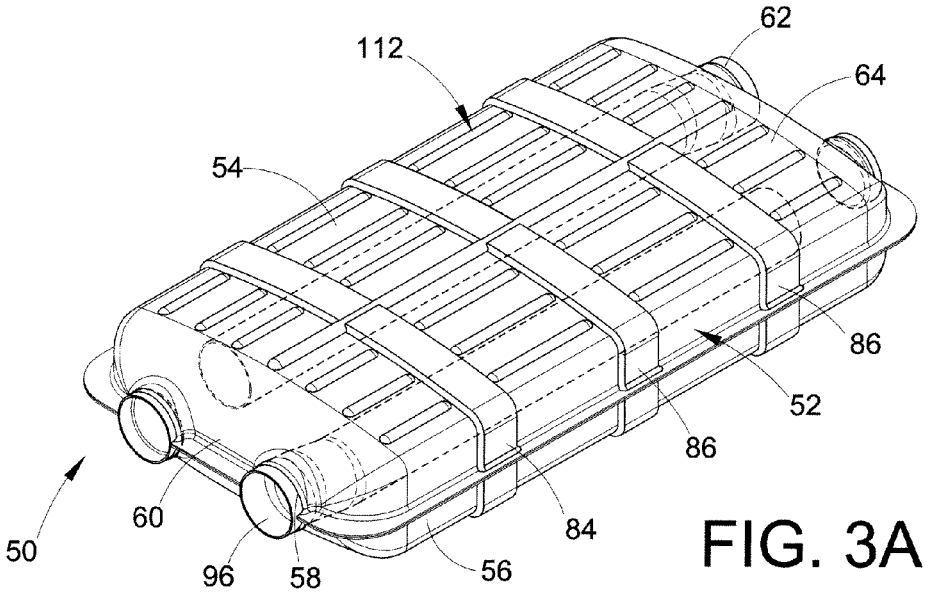
FIGS. 3A and 3B are intake side and exhaust side perspective views of the silencer of FIG. 2 shown in an assembled state.
Figure 3B:
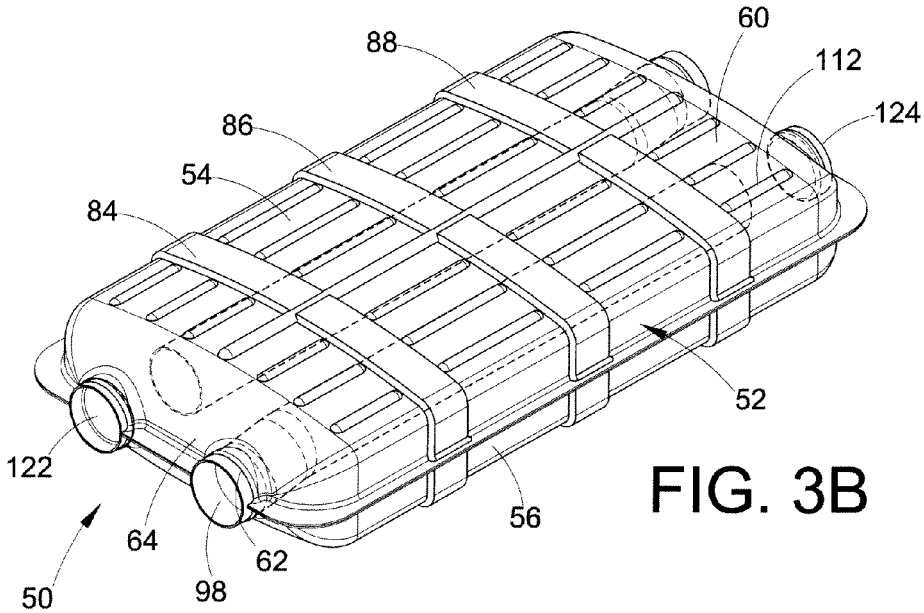
Figure 8:
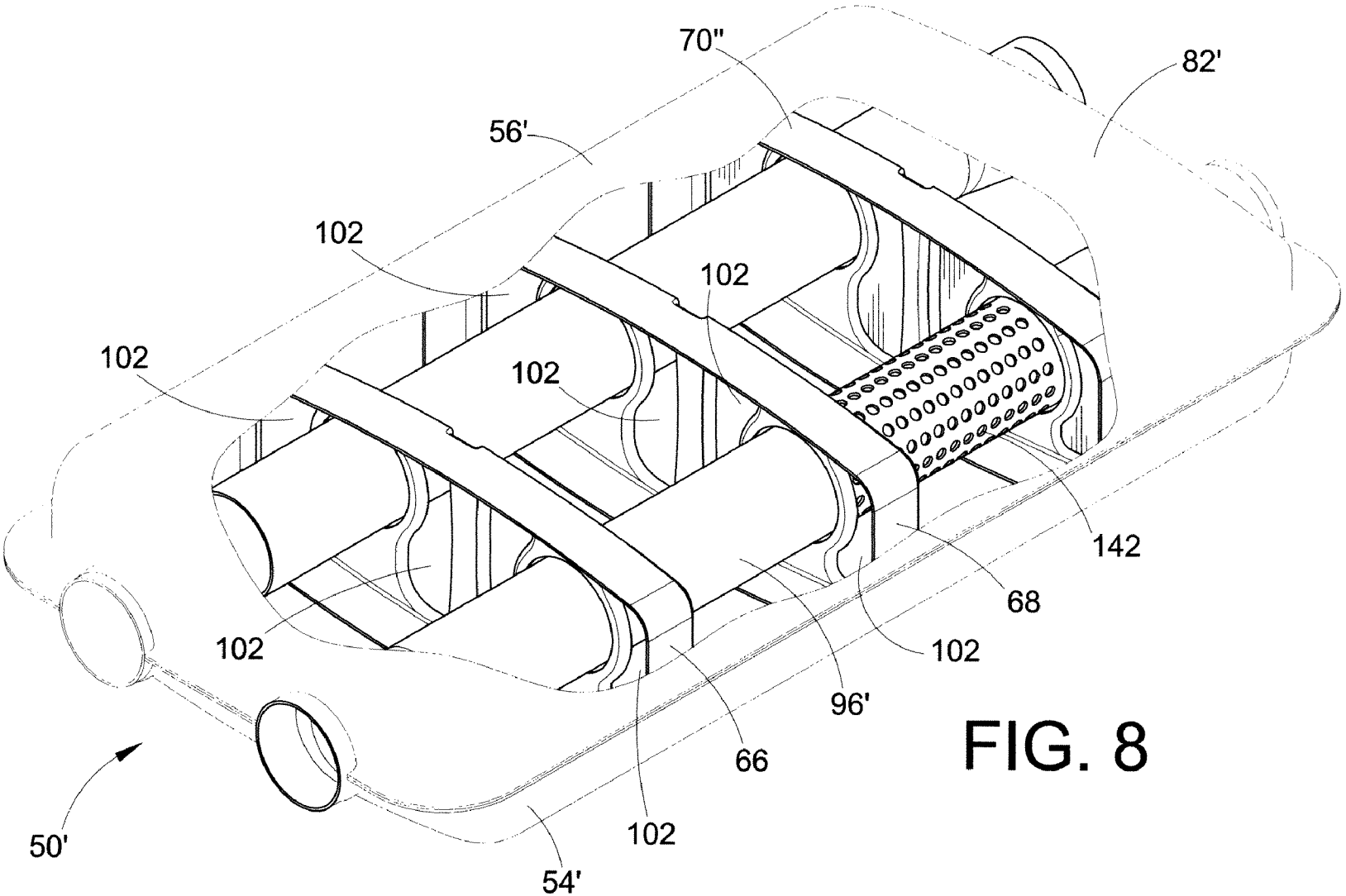
FIG. 8 is a perspective view of an improved silencer according to an alternate embodiment.

With reference to FIG. 8, an alternate silencer 50' is illustrated, which is the same as silencer 50 of FIG. 3 except as indicated below. In particular, separator 70 of silencer 50 is replaced with solid separator 70" and intake pipe section 96 is replaced with intake pipe section 96' having circumferential perforation holes 142 defined along a portion thereof. Although not illustrated, it is to be appreciated and understood by those skilled in the art that the other separators 66, 68 shown having large apertures 102 could be substituted for the perforated separators 66', 68' of FIG. 7. Employing the solid wall separator 70" in the silencer 50' of FIG. 8 creates a Helmholtz resonator chamber 82', whereas the remaining chambers 76, 78, 80 (FIG. 4) function as a single expansion volume area. The separator 70" can be formed similarly to the separators 66, 68 (or separators 66', 68'), but with one less piercing process.

Figure 9A:
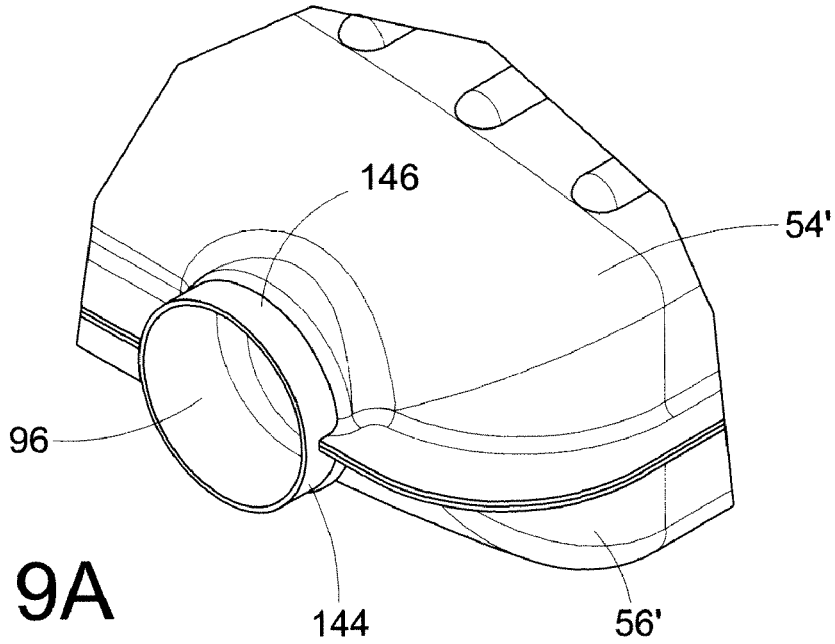
FIG. 9A is a partial perspective view of the silencer of FIG. 8 showing a drawn end cap portion punched through to form an intake port.
Figure 9B:
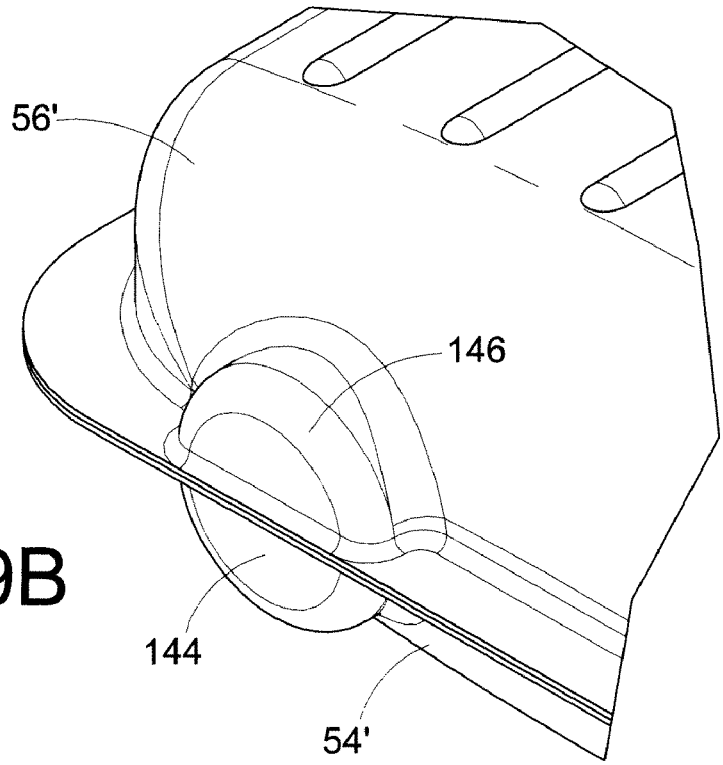
FIG. 9B is a partial perspective view of the silencer of FIG. 8 showing a non-punched through end cap.

In addition, the lower and upper housing members 54, 56 are replaced with housing members 54', 56', wherein no open or recessed port portions (e.g., port portion 58*a*, 58*b*) are provided. Instead, and with additional reference to FIGS. 9A and 9B, the housing members 54', 56' are formed with closed port portions 144, 146 that can be punched or drilled out to receive intake or exhaust pipe sections 96, 98 as appropriate. More specifically, the port portions 144,146 can be punched out as shown in FIG. 9A for receipt of one of the pipe sections (e.g., intake pipe section 96) or left closed as shown in FIG. 9B. The illustrated configuration of the housing members 54, 56 also allows for the housing members 54', 56' to be drawn instead of stamped when formed, though this is not required. Although the housing members 54', 56' are shown without attenuating ribs (e.g., ribs 112 of housing members 54, 56), ribs could be included if desired.

Figure 10:
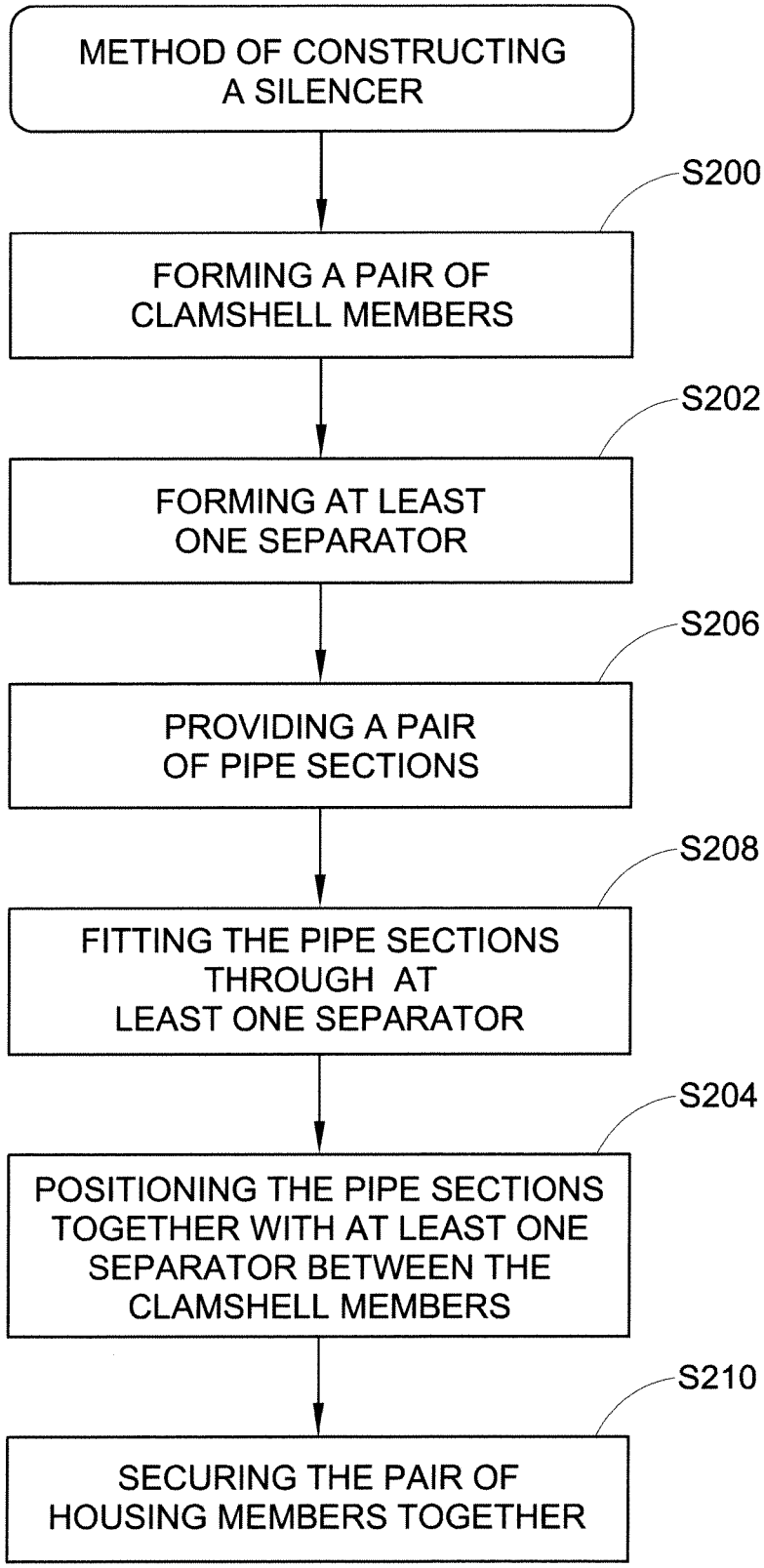
FIG. 10 is a flow chart illustrating a method of constructing a silencer.
Figures 11A, 11B:
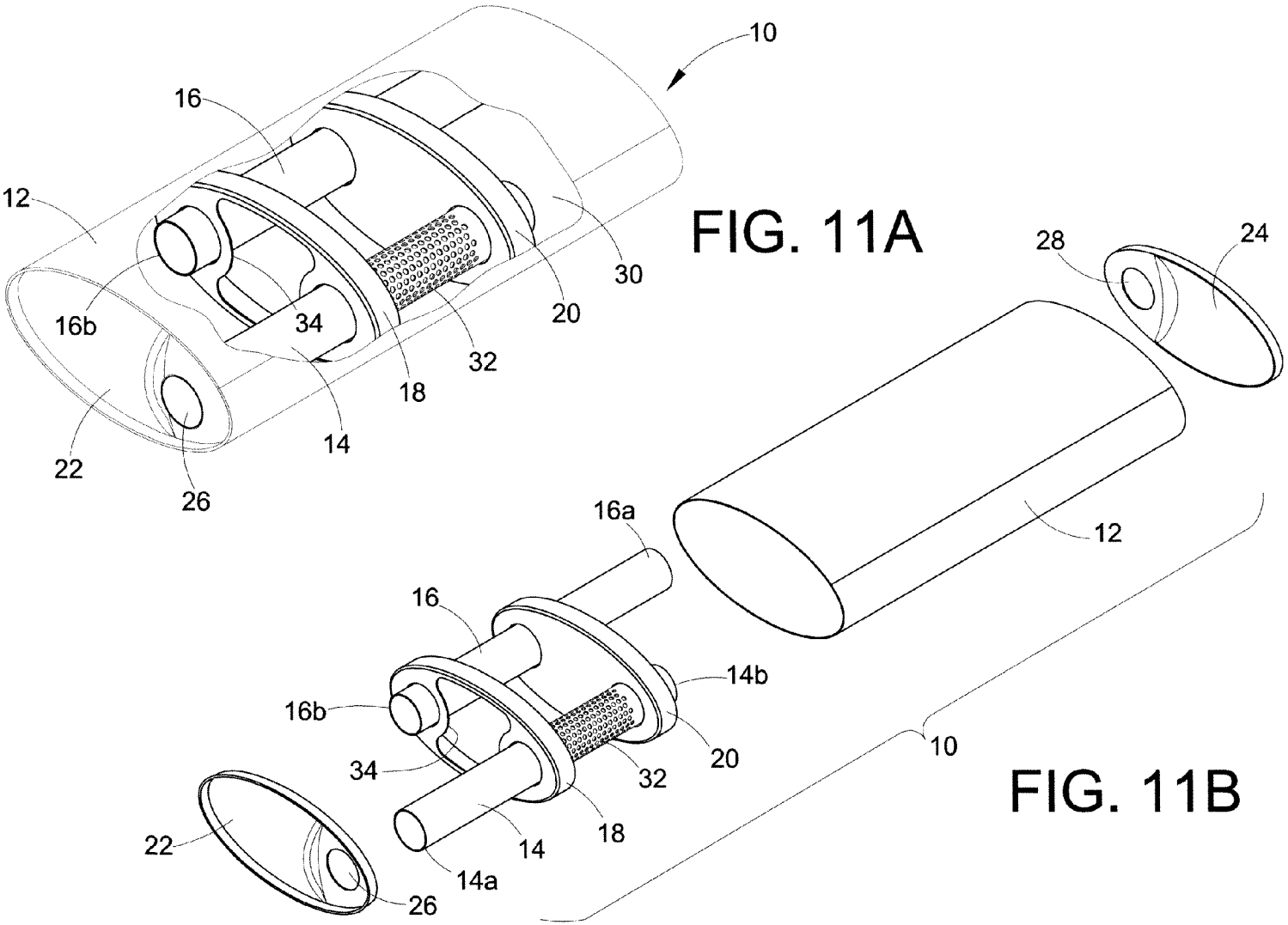
FIG. 11A is a perspective view of a prior art silencer.
FIG. 11B is an exploded view of the silencer of FIG. 11A.

A method of constructing a silencer, such as silencer 50, for an internal combustion engine will now be described with reference to FIG. 10. In the method, the pair of clamshell housing members 54, 56 each having a substantially identical configuration relative to one another are first formed (S200). Forming the housing members 54, 56 can include forming each of the housing members 54, 56 independently via sheet metal stamping (FIG. 2) or alternatively by drawing (FIG. 8). Next, at least one separator is formed (S202), such as separators 66, 68, 70. The separators 66, 68, 70 are positioned between the housing members 54, 56 for dividing a cavity formed between the housing members when the housing members are brought together (S204). Positioning of the separators 66, 68, 70 can include positioning the separators 66, 68, 70 in a spaced apart relation longitudinally along the housing members 54, 56. As illustrated, the separators 66, 68, 70 are each oriented transversely relative to a longitudinal length of the housing members 54, 56.

Prior to fitting the separators 66, 68, 70 in the housing members 54, 56 in S204, the pair of pipe sections, such as pipe sections 96, 98, each having a substantially identical configuration relative to one another can be provided (S206). The pipe sections 96, 98 can be fitted through the separators 66, 68, 70 (S208). The pipe sections 96, 98 together with the separators 66, 68, 70 can then be positioned in S204 between the housing members 54, 56 when the housing members are brought together. Fitting the pipe sections 96, 98 through the separators 66, 68, 70 can include press-fitting or welding the pipe sections 96, 98 to the separators 66, 68, 70. The housing members 54, 56 are secured to one another to form the cavity therebetween and lock the separators 66, 68, 70 each longitudinally between the housing members 54, 56 (S210). As already mentioned herein, securing the clamshell housing members 54, 56 to one another can include welding or hemming (e.g., single hemming or double hemming) the housing members together along the seam 108 defined therebetween.

The exemplary embodiment(s) have been described with reference to the preferred embodiments. Obviously, modifications and alterations will occur to others upon reading and understanding the preceding detailed description. It is intended that the exemplary embodiment be construed as including all such modifications and alterations insofar as they come within the scope of the appended claims or the equivalents thereof.

The invention claimed is:

1. A silencer for an internal combustion engine, comprising:

a silencer housing formed by a pair of clamped housing members each having a substantially identical configuration relative to one another, said silencer housing having an intake port formed at a first end and an exhaust port formed at a second, opposite end; and at least one separator received in said silencer housing between and spaced apart from said first end and said second end, said at least one separator extending transversely across said silencer housing relative to a longitudinal length of said silencer housing, wherein said silencer housing has an interior wall surface defining spaced apart circumferential recesses, said at least one separator being received in one of said recesses so as to be longitudinally locked when said pair of housing members are secured to one another, wherein said silencer housing includes elongated ribs extending along said longitudinal length of said silencer housing to attenuate resonance in the silencer, said elongated ribs being positioned between said recesses, and an intake pipe section extending from said intake port through said at least one separator; and an exhaust pipe section extending from said exhaust port through said at least one separator, said intake pipe section and said exhaust pipe section having substantially identical configurations relative to one another, wherein said silencer housing defines a pair of ports at each of said first end and said second end, one of said pair of ports at said first end forming said intake port and the other of said pair of ports at said first end closed with an end cap, one of said pair of ports at said second end forming said exhaust port and the other of said pair of ports at said second end closed with another end cap.

2. The silencer of claim 1 wherein each of said pair of housing members is independently formed as a single stamped metal piece.

3. The silencer of claim 1 wherein said at least one separator includes a first separator and a second separator, said first and second separators having a substantially identical configuration relative to one another and are spaced apart from one another along said longitudinal length of said silencer housing.

4. The silencer of claim 3 wherein said first and said second separators are each independently formed of stamped sheet metal.

5. The silencer of claim 3 wherein said at least one separator includes a third separator, said third separator having a substantially identical configuration as said first and said second separators and spaced apart from said first and said second separators along said longitudinal length of said silencer housing.

6. The silencer of claim 3 wherein said first and said second separators divide an interior of said silencer housing into separate expansion chambers.

7. The silencer of claim 3 wherein said first and said second separators include a plurality of perforated holes.

8. The silencer of claim 1 wherein said intake pipe section and said exhaust pipe section are fitted through respective apertures in said at least one separator, and said pipe sections are secured to said at least one separator via press-fit or welding.

9. The silencer of claim 1 wherein said pair of housing members are secured to one another along a seam via welding or hemming.

10. The silencer of claim 9 wherein said pair of housing members are secured to one another along said seam via double hemming.

11. A method of constructing a silencer for an internal combustion engine, comprising:

forming a pair of clamshell housing members each having a substantially identical configuration relative to one another, said pair of housing members together defining a pair of ports at each of a first end and a second, opposite end of the silencer, one of said pair of ports at said first end forming an intake port and one of said pair of ports at said second end forming an exhaust port;

closing the other of said pair of ports at said first end with an end cap and closing the other of said ports at said second end with an end cap;

forming a pair of separators each having a substantially identical configuration relative to one another;

positioning said pair of separators between said pair of clamshell housing members for dividing a cavity formed between said housing members when said housing members are brought together, said pair of separators oriented transversely relative to a longitudinal length of said pair of housing members; and securing said pair of housing members to one another to form said cavity therebetween and lock said pair of separators longitudinally between said pair of housing members.

12. The method of claim 11 wherein securing said pair of housing members includes mating respective interior wall surfaces of said housing members with a circumferential edge of each separator circumferentially continuously about said at least one separator.

13. The method of claim 11 wherein forming said pair of clamshell housing members includes forming each of said pair of clamshell housing members independently via sheet metal stamping.

14. The method of claim 11 wherein said pair of separators is a first separator and a second separator, and wherein said positioning of said pair of separators includes positioning said first and second separators in spaced apart relation longitudinally along said housing members, and further wherein said first and second separators are each independently formed via sheet metal stamping.

15. The method of claim 11 further including:

providing a pair of pipe sections each having a substantially identical configuration relative to one another; and fitting said pipe sections through said pair of separators, wherein positioning said pair of separators includes positioning said pair of pipe sections together with said at least one separator between said pair of clamshell housing members when said housing members are brought together, one of said pair of pipe sections extending from said intake port through said pair of separators, the other of said pair of pipe sections extending from said exhaust port through said pair of separators.

16. The method of claim 15 wherein fitting said pipe sections through said pair of separators includes press-fitting or welding said pipe sections to said pair of separators.

17. The method of claim 12 wherein securing said pair of clamshell housing members to one another includes double hemming said pair of clamshell housing members together along a seam defined therebetween.

* * * * *